US006888516B2

(12) United States Patent
Amatsuchi et al.

(10) Patent No.: US 6,888,516 B2
(45) Date of Patent: May 3, 2005

(54) DISPLAY PANEL AND SCANNING METHOD

(75) Inventors: Mario Amatsuchi, Yamanashi-ken (JP); Chiharu Koshio, Yamanashi-ken (JP); Kimio Amemiya, Yamanashi-ken (JP); Yasuhiro Torisaki, Yamanashi-ken (JP)

(73) Assignees: Pioneer Corporation, Tokyo (JP); Pioneer Display Corporation, Shizuoka (JP)

( * ) Notice: Subject to any disclaimer, the term of this patent is extended or adjusted under 35 U.S.C. 154(b) by 291 days.

(21) Appl. No.: 10/183,162

(22) Filed: Jun. 28, 2002

(65) Prior Publication Data

US 2003/0016193 A1 Jan. 23, 2003

(30) Foreign Application Priority Data

Jul. 19, 2001 (JP) ..... P2001-219112

(51) Int. Cl.[7] ..... G09G 3/28

(52) U.S. Cl. ..... 345/60; 345/63; 345/72; 345/694; 345/695; 345/696

(58) Field of Search ..... 345/60, 63, 72, 345/694, 695, 696

(56) References Cited

U.S. PATENT DOCUMENTS 6,184,853 B1 * 2/2001 Hebiguchi et al. ..... 345/88

* cited by examiner

*Primary Examiner*—Richard Hjerpe
*Assistant Examiner*—Jean Lesperance
(74) *Attorney, Agent, or Firm*—Norgan, Lewis & Bockius LLP

(57) ABSTRACT

An object of the present invention is to provide a high definition PDP screen without lowering the PDP luminescence efficiency. The display panel is provided with a plurality of cells that are arranged in a matrix, each of the plurality of cells emitting a different unique luminescent color; wherein a plurality of cells each bearing first luminescent color are disposed on every other line in a vertical direction, and a line of cells each having second luminescent color and a line of cells each having third luminescent color are alternated with a line of said plurality of cells having first luminescent color respectively therebetween.

6 Claims, 7 Drawing Sheets

| | | | | | | | | | | | | |
|---|---|---|---|---|---|---|---|---|---|---|---|---|
| L1 | G | R | G | R | G | R | G | R | G | R | G | R |
| L2 | B | B | B | B | B | B | B | B | B | B | B | B |
| L3 | R | G | R | G | R | G | R | G | R | G | R | G |
| L4 | B | B | B | B | B | B | B | B | B | B | B | B |
| L5 | G | R | G | R | G | R | G | R | G | R | G | R |
| L6 | B | B | B | B | B | B | B | B | B | B | B | B |
| L7 | R | G | R | G | R | G | R | G | R | G | R | G |
| L8 | B | B | B | B | B | B | B | B | B | B | B | B |
| L9 | G | R | G | R | G | R | G | R | G | R | G | R |

FIG. 7

| | | | | | | | | | | | | |
|---|---|---|---|---|---|---|---|---|---|---|---|---|
| L1 | R | R | R | R | R | R | R | R | R | R | R | R |
| L2 | G | G | G | G | G | G | G | G | G | G | G | G |
| L3 | B | B | B | B | B | B | B | B | B | B | B | B |
| L4 | G | G | G | G | G | G | G | G | G | G | G | G |
| L5 | R | R | R | R | R | R | R | R | R | R | R | R |
| L6 | G | G | G | G | G | G | G | G | G | G | G | G |
| L7 | B | B | B | B | B | B | B | B | B | B | B | B |
| L8 | G | G | G | G | G | G | G | G | G | G | G | G |
| L9 | R | R | R | R | R | R | R | R | R | R | R | R |

FIG. 8

| | | | | | | | | | | | | |
|---|---|---|---|---|---|---|---|---|---|---|---|---|
| L1 | G | G | G | G | G | G | G | G | G | G | G | G |
| L2 | R | R | R | R | R | R | R | R | R | R | R | R |
| L3 | B | B | B | B | B | B | B | B | B | B | B | B |
| L4 | R | R | R | R | R | R | R | R | R | R | R | R |
| L5 | G | G | G | G | G | G | G | G | G | G | G | G |
| L6 | R | R | R | R | R | R | R | R | R | R | R | R |
| L7 | B | B | B | B | B | B | B | B | B | B | B | B |
| L8 | R | R | R | R | R | R | R | R | R | R | R | R |
| L9 | G | G | G | G | G | G | G | G | G | G | G | G |

FIG. 9

| | | | | | | | | | | | | |
|---|---|---|---|---|---|---|---|---|---|---|---|---|
| L1 | G | B | G | B | G | B | G | B | G | B | G | B |
| L2 | R | R | R | R | R | R | R | R | R | R | R | R |
| L3 | B | G | B | G | B | G | B | G | B | G | B | G |
| L4 | R | R | R | R | R | R | R | R | R | R | R | R |
| L5 | G | B | G | B | G | B | G | B | G | B | G | B |
| L6 | R | R | R | R | R | R | R | R | R | R | R | R |
| L7 | B | G | B | G | B | G | B | G | B | G | B | G |
| L8 | R | R | R | R | R | R | R | R | R | R | R | R |
| L9 | G | B | G | B | G | B | G | B | G | B | G | B |

FIG. 10

| | | | | | | | | | | | | |
|---|---|---|---|---|---|---|---|---|---|---|---|---|
| L1 | R | B | R | B | R | B | R | B | R | B | R | B |
| L2 | G | G | G | G | G | G | G | G | G | G | G | G |
| L3 | B | R | B | R | B | R | B | R | B | R | B | R |
| L4 | G | G | G | G | G | G | G | G | G | G | G | G |
| L5 | R | B | R | B | R | B | R | B | R | B | R | B |
| L6 | G | G | G | G | G | G | G | G | G | G | G | G |
| L7 | B | R | B | R | B | R | B | R | B | R | B | R |
| L8 | G | G | G | G | G | G | G | G | G | G | G | G |
| L9 | R | B | R | B | R | B | R | B | R | B | R | B |

DISPLAY PANEL AND SCANNING METHOD

BACKGROUND OF THE INVENTION

1. Field of the Invention

The present invention relates to a display panel for use in such as a plasma display (hereinafter referred to as PDP), an organic EL (electro luminescence) display, FED (Field Emission Display), a liquid crystal display, used as a display device, for example, and a scanning method used in the display panel.

2. Description of the Related Art

In recent years, there have appeared AC (Alternating Current) type surface discharge PDPs in the market. Those PDPs are suitable for full-color display. The surface discharge PDPs are PDPs that use a matrix system respectively. For example, in a reflection type three-electrode surface discharge PDP, a plurality of row electrode pairs that form display lines and a dielectric layer that covers the inner face of the front substrate are provided on the inner face of the front substrate that functions as a display screen. On the inner face of the back substrate disposed so as to face the front substrate with a discharge space therebetween are disposed a plurality of column electrodes in the direction orthogonal to the row electrode pairs. Each of the column electrodes is composed of a discharge cell at a crossing portion with a row electrode pair, a partition wall that divides discharge cells in the line (row) direction and/or in the column direction in the discharge space, luminescence layers of three colors (Red (to be abbreviated as R), Green (to be abbreviated as G), and Blue (to be abbreviated as G)) so as to cover the column electrodes and the side faces of the partition wall. Each discharge cell, when it is selected by any of the three types of conductive electrode lines, emits a light in a predetermined color. An Ne—Xe discharge gas is sealed in the discharge space.

There have been proposed various methods for the arrangement of R, G, and B colors in such the PDP. FIG. 11 shows a general method used for such the arrangement of three colors in a PDP.

Every other line is selected in each field to make cells to emit their colors sequentially. For example, at first, cells are selected from odd number lines of 1, 3, 5, . . . as shown in FIG. 12, then cells are selected from even number lines of 2, 4, 6, . . . as shown in FIG. 13. After this, cells are selected again from odd number lines of 1,3,5, . . . as shown in FIG. 12. In other words, scanning is done for alternate lines as shown in FIGS. 12 and 13 so as to emit colors. Such the display method is referred to as an interlace display.

However, in the case of a PDP that uses the above described cell arrangement, an attempt of a definition display has caused a problem that the cell sizes in length and width has had to be reduced and the reduction of the cell sizes has caused the cell area to be reduced, thereby the luminescence efficiency has been lowered.

SUMMARY OF THE INVENTION

Taking the aforementioned problem into consideration, it is an object of the present invention to provide a high definition PDP screen without lowering the PDP luminescence efficiency.

The above object of the present invention can be achieved by a display panel of the present invention. The display panel is provided with a plurality of cells that are arranged in a matrix, each of the plurality of cells emitting a different unique luminescent color; wherein a plurality of cells each bearing first luminescent color are disposed on every other line in a vertical direction, and a line of cells each having second luminescent color and a line of cells each having third luminescent color are alternated with a line of said plurality of cells having first luminescent color respectively therebetween.

According to the present invention, for example, three colors of R, G, and B are defined as luminescent colors and the first luminescent color is defined as R, the second luminescent color as G, and the third luminescent color as B. Then, the number of cells having the first luminescent color R is set as double the number of cells having the second luminescent color G and the number of cells having the third luminescent color B respectively. This is why the present invention can realize a high definition display.

The above object of the present invention can be achieved by a display panel of the present invention. The display panel is provided with a plurality of cells that are arranged in a matrix, each of the plurality of cells emitting a different unique luminescent color; wherein said plurality of cells having first luminescent color respectively are disposed on every other line in a vertical direction and a line on which cells having said second luminescent color and cells having said third luminescent color are disposed alternately between lines consisting of cells having said first luminescent color respectively.

According to the present invention, for example, R, G, and B are defined as three luminescent colors and the first luminescent color is defined as B, the second luminescent color as G, and the third luminescent color as R. Then, the number of cells having the first luminescent color B is set as double the number of cells having the second luminescent color G and the number of cells having the third luminescent color R respectively. This is why the present invention can realize a high definition display.

Furthermore, because the luminescence center of the cells having the second luminescent color G and the third luminescent color R comes actually to an intermediate line (a cell line having the first luminescent color B), it is possible to improve the vertical resolution of the cells having the second and third luminescent colors G and R. This is why the present invention can realize a high definition display.

In one aspect of the present invention, a display panel of the present invention is a plasma display panel.

According to the present invention, for example, R, G, and B are also defined as three luminescent colors for three types of cells of a plasma display and the luminescent color R is defined as the color of the first cells, the luminescent color G is defined as the color of the second cells, and the luminescent color B is defined as the color of the third cells. Then, the number of the first cells R is set as double the number of the second cells G and the number of the third cells B respectively. This is why the present invention can realize a high definition display.

The above object of the present invention can be achieved by a scanning method of the present invention. The scanning method used in a display panel is provided with a plurality of cells that are arranged in a matrix, each of the plurality of cells emitting a different unique luminescent color; wherein said scanning method uses an interlacing method to drive said display panel in which a plurality of cells each bearing first luminescent color are disposed on every other line in a vertical direction and a line of cells having second luminescent color and a line of cells having third luminescent color are disposed alternately with a line of cells having said first luminescent color therebetween; wherein a plurality of lines, each consisting of cells having said first luminescent color, are divided into a first line group and a second line group so that lines of said first and second groups are alternated; wherein scanning in a first field is done sequentially for a line consisting of cells having said first luminescent color, then its adjacent line consisting of cells having said second or third luminescent color in said first line group; and wherein scanning in a second field is done sequentially for a line consisting of cells having said first luminescent color, then its adjacent line consisting of cells having said second or third luminescent color in said second line group.

According to the present invention, for example, the first and second scanning operations are duplicated for the same luminescent color line. Conventionally, the first and second scanning operations are done for different lines. Consequently, the present invention improves the screen density by the rate of the luminescent color lines duplicated in the first and second scanning operations to all the luminescent color lines.

The above object of the present invention can be achieved by a scanning method of the present invention. The scanning method used in a display panel is provided with a plurality of cells that are arranged in a matrix, each of the plurality of cells emitting a different unique luminescent color; wherein said scanning method uses an interlacing method to drive said display panel in which a plurality of cells each bearing first luminescent color are disposed on every other line in a vertical direction and a plurality of cells having second luminescent color and a plurality of cells having third luminescent color are disposed alternately in a line between lines, each consisting of cells having said first luminescent color; wherein a plurality of lines, each consisting of cells having said first luminescent color, are divided into a first line group and a second line group so that a line in said first line group and a line in said second line group are alternated; wherein scanning in a first field is done sequentially for a line of cells having said first luminescent color, then its adjacent line on which cells having said second luminescent color and cells having said third luminescent color are disposed alternately in said first line group; and wherein scanning in a second field is done sequentially for a line consisting of cells having said first luminescent color, then its adjacent line on which cells having said second luminescent color and cells having said third luminescent color are disposed alternately in said second line group.

According to the present invention, the first and second scanning operations are done for the same luminescent color line. Conventionally, the first and second scanning operations are done for different luminescent color lines. Consequently, the present invention comes to improve the screen density by the rate of the luminescent color lines duplicated in the first and second scanning operations to all the scanned luminescent color lines. In addition, because the luminescence center of the second and third luminescent color cells comes practically to an intermediate line (a line of the first luminescent color cells), it is possible to improve the vertical resolution of the second and third luminescent color cells. This is why the present invention can realize a high definition display.

In one aspect of the present invention, a display panel of the above mentioned method is achieved by a plasma display panel.

According to the present invention, for example, the first and second scanning operations are done for the same luminescent color line. Conventionally, the first and second scanning operations are done for different luminescent color lines. Consequently, the present invention comes to improve the screen density by the rate of luminescent color lines duplicated in the first and second scanning operations to all the scanned luminescent color lines.

BRIEF DESCRIPTION OF THE DRAWINGS

FIG. 7 is a chart for denoting cell arrangement in the third embodiment of the present invention;

FIG. 8 is a chart for denoting cell arrangement in the fourth embodiment of the present invention;

FIG. 9 is a chart for denoting cell arrangement in the fifth embodiment of the present invention;

FIG. 10 is a chart for denoting cell arrangement in the sixth embodiment of the present invention;

DETAILED DESCRIPTION OF THE PREFERRED EMBODIMENTS

<First Embodiment>

Hereunder, a description will be made for the first embodiment in which the display panel of the present invention applies to a plasma display panel (PDP) with reference to FIGS. 1 to 3.

Figure 1:
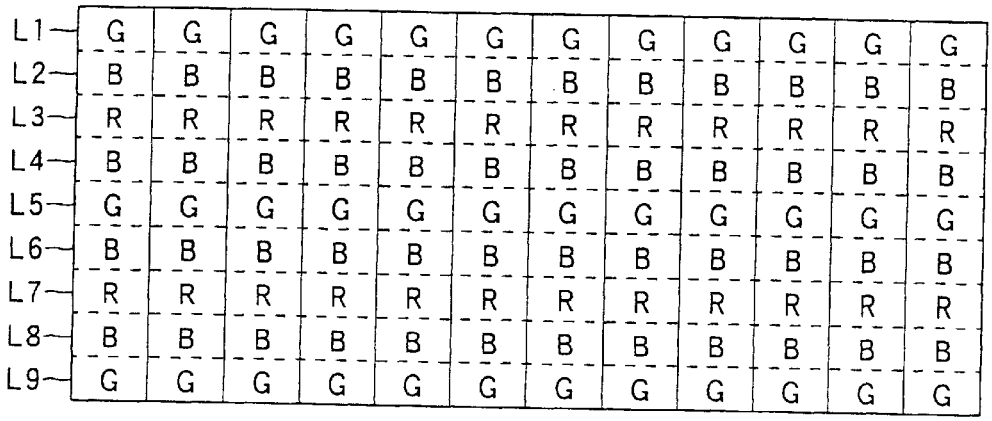
FIG. 1 is a chart for denoting arrangement of cells in the first embodiment of the present invention.

FIG. 1 shows a vertical front view of a PDP screen in the first embodiment of the present invention. Three colors of Red (hereinafter, to be abbreviated as R), Green (hereinafter, to be abbreviated as G), and Blue (hereinafter, to be abbreviated as B) are arranged in respective plasma cells. On this PDP screen are disposed N (natural number) plasma cells side by side in parallel in the horizontal direction, which is the longitudinal direction of the screen. In the vertical direction are disposed plasma cells divided in units of M cells. Row electrode pairs X1, Y1 to XN, YN are disposed so that a row electrode pair X1, Y1 is corresponded to each plasma cell disposed in the row direction. Each row electrode pair is connected to an X electrode driver XD and a Y electrode driver YD respectively. In addition, in the column direction are disposed data lines D1 to DM. Each data line is connected to an address driver AD. In other words, the PDP screen is composed of N(rows)×M(columns) of plasma cells so that single color plasma cells are disposed in the row direction and three color plasma cells are disposed in a regular pattern in the column direction. In this first embodiment, the colors are arranged in a repetitive pattern of G, B, R, B . . . in the column direction.

Concretely, B cells are disposed on every other line and a line consisting of G cells and a line consisting of R cells are disposed above and below an adjacent B cell line respectively in the vertical line (FIG. 1). In FIG. 1, only the nine lines beginning at the top are shown. The number of actual columns is more than those shown in FIG. 2.

A plurality of B cell lines are divided into a first line group and a second line group so that lines in those two groups are alternated.

Figure 2:
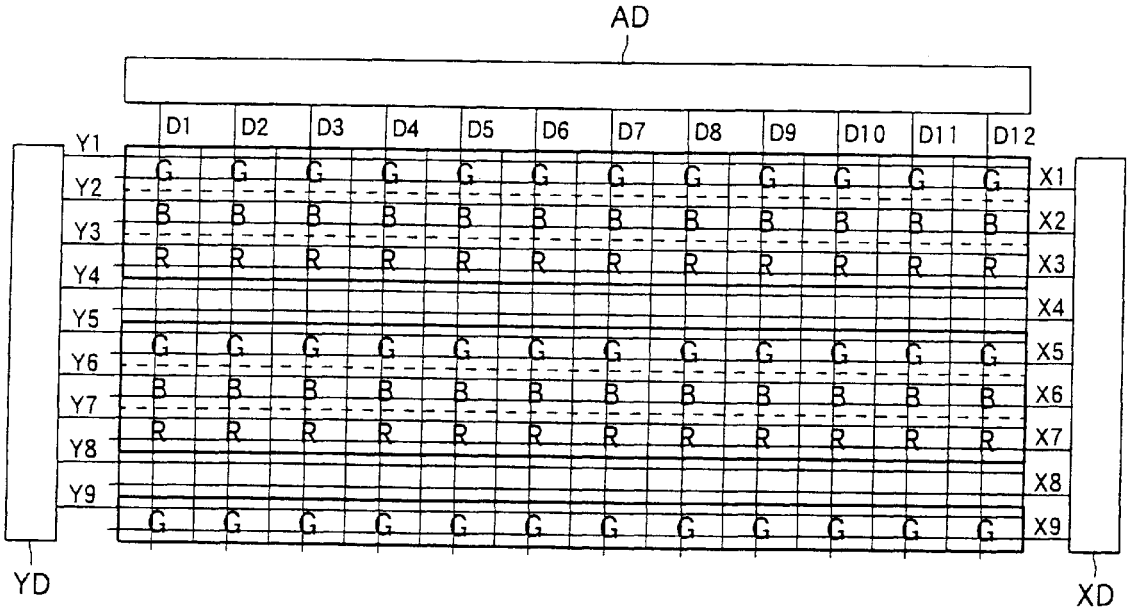
FIG. 2 is a first field in an interlace display with the cell arrangement in the first embodiment of the present invention.
Figures 3, 4:
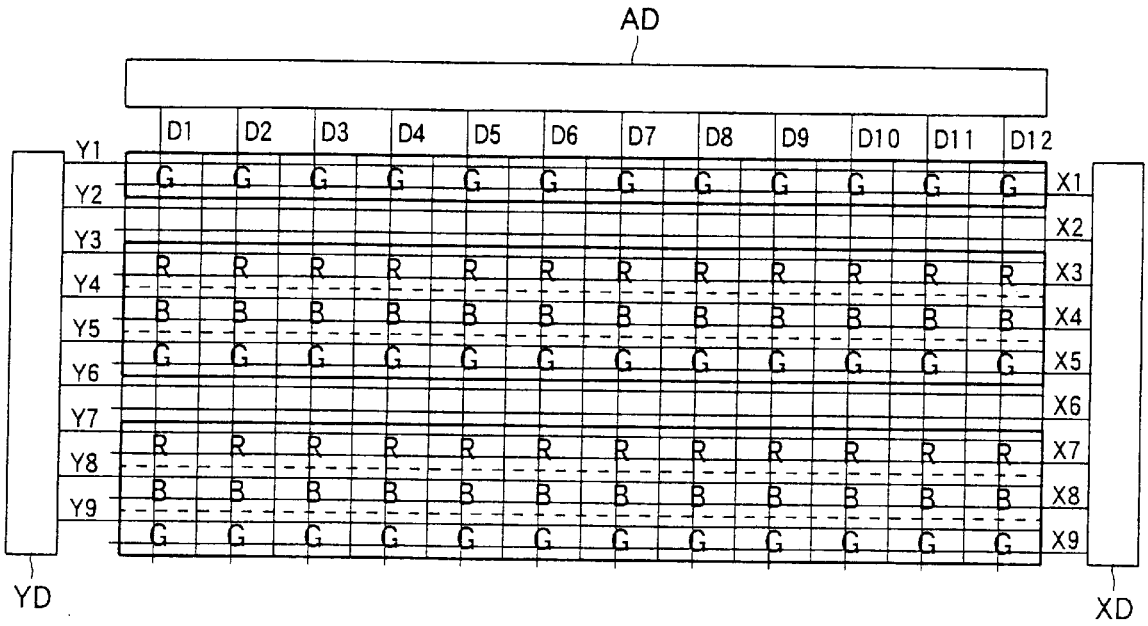
FIG. 3 is a second field in an interlace display with the cell arrangement in the first embodiment of the present invention.
FIG. 4 is a chart for denoting cell arrangement in the second embodiment of the present invention.

FIG. 2 shows a display in the first field and FIG. 3 shows a display in the second field.

In this first embodiment, the first and second fields are alternated repetitively (interlace display).

The first line group includes 2+every 4(n)-th line (n: 0, 1, 2, . . . ) from the top in FIG. 2, that is, the second line L2, the sixth line L6, the tenth line L10, . . . in FIG. 2.

The second line group includes every 4(n)-th line (n: 1, 2, . . . ) from the top in FIG. 3, that is, the fourth line L4, the eighth line L8, the twelfth line L12 in FIG. 3.

In the first field, scanning is done line by line sequentially, beginning at a B cell line, an adjacent G cell line, and an adjacent R cell line included in the first line group.

In other words, scanning is done line by line, beginning at the first line L1 (G cell line) on which the row electrode pair X1, Y1 is provided, the second line L2 (B cell line) on which the row electrode pair X2, Y2 is provided, the third line L3 (R cell line) on which the row electrode X3, Y3 is provided, the fifth line L5 (G cell line) on which the row electrode pair X5, Y5 is provided, the sixth line L6 (B cell line) on which the row electrode pair X6, Y6 is provided, the seventh line L7 (R cell line) on which the row electrode pair X7, Y7 is provided, the ninth line L9 (G cell line) on which the row electrode X9, Y9 is provided, . . . sequentially.

In the second field, scanning is done line by line sequentially, beginning at a B cell line, an adjacent G cell line, an adjacent R cell line in the second line group.

In other words, scanning is done line by line, beginning at the first line L1 (G cell line) on which the row electrode pair X1, Y1 is provided, the third line L3 (R cell line) on which the row electrode pair X3, Y3 is provided, the fourth line L4 (B cell line) on which the row electrode pair X4, Y4 is provided, the fifth line L5 (G cell line) on which the row electrode pair X5, Y5 is provided, the seventh line L7 (R cell line) on which the row electrode pair X7, Y7 is provided, the eighth line L8 (B cell line) on which the row electrode pair X8, Y8 is provided, . . . sequentially.

Figure 11:
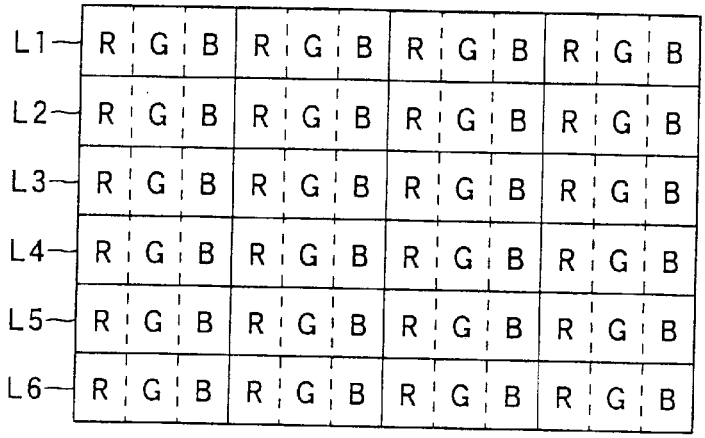
FIG. 11 is a chart for denoting a conventional cell arrangement.
Figure 12:
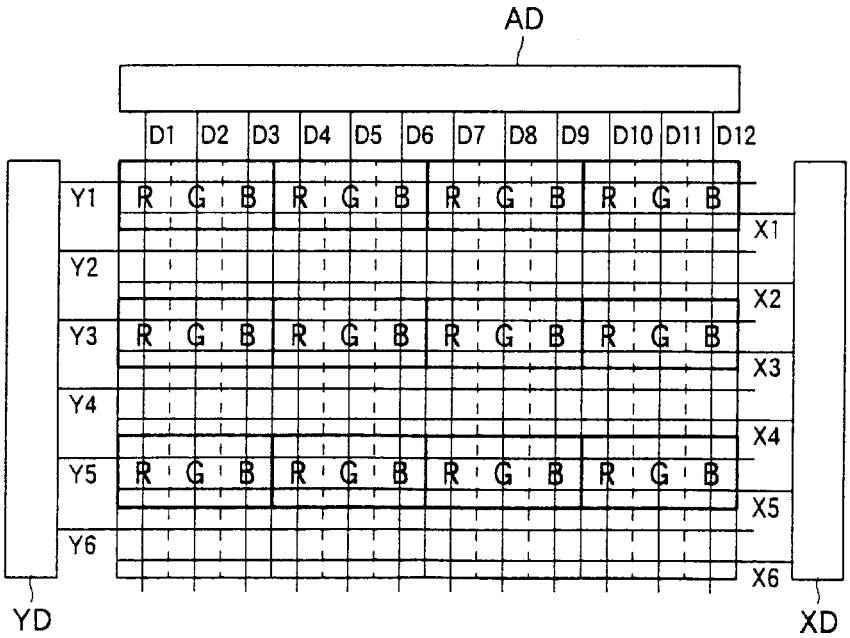
FIG. 12 is a field in an interlace display with the conventional cell arrangement.
Figure 13:
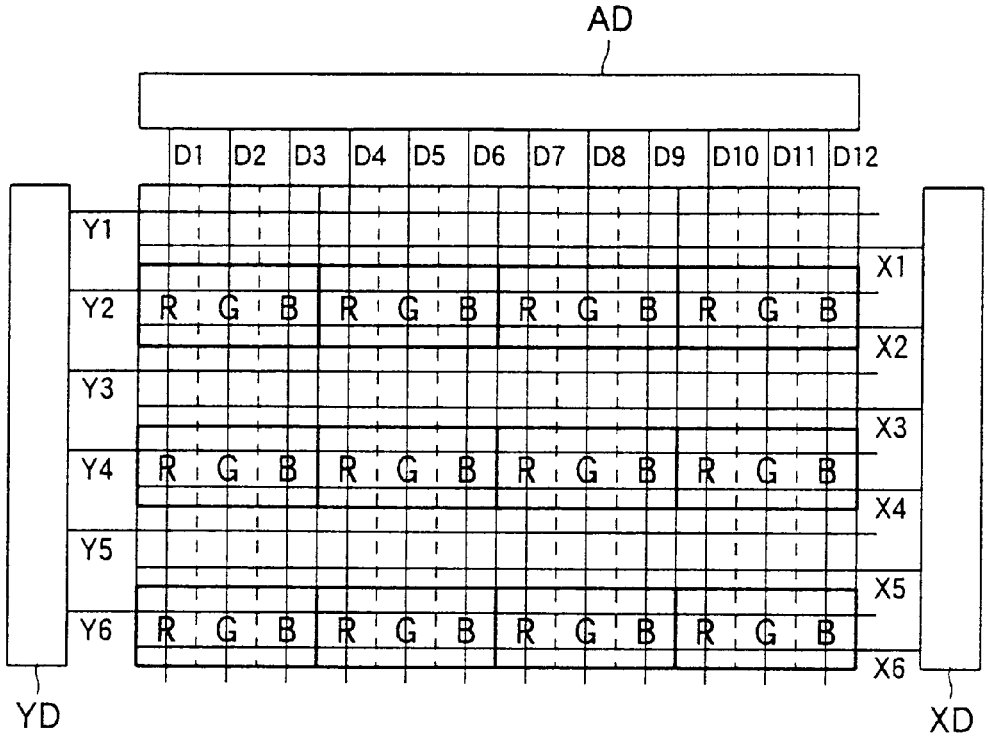
FIG. 13 is another field in the interlacing display with the conventional cell arrangement.

By the way, a pixel recognized by human beings as a point is actually a combination of three plasma display cells, that is, R, G, and B. According to the first embodiment described above, the total number of plasma display cells of each of R, G, and B is 9 rows×12 columns, that is, 108 cells that form one screen. Because one pixel is a combination of three plasma display cells of R, G, and B as described above, 24 pixels are displayed by the scanning shown in FIG. 2 and 24 pixels are displayed by the scanning shown in FIG. 3 among the total number of 108 cells (9 rows×12 columns) respectively in the first embodiment. In the first embodiment, an interlace scanning method is used, so that the scanning shown in each of FIG. 2 and FIG. 3 is done once to display 24 pixels on one screen, respectively. A total of 48 pixels are thus displayed on one screen. On the other hand, because the total number of cells existing on one screen is 108, how many pixels among the total number of cells are to be displayed on one screen can be calculated as follows. 48 (pixels)/108 (plasma display cells)=0.444. Thus, about 44.4% is the rate of pixels to be displayed on one screen. Similar calculation is done for the conventional examples shown in FIGS. 11 through 13. Because the total number of cells existing on one screen is 6 (rows)×12 (columns)=72 and 12 pixels are displayed by the scanning shown in FIG. 12 and by the scanning shown in FIG. 13 respectively, a total of 24 pixels come to be displayed on one screen. Similarly to the first embodiment, how many pixels among the total number of cells are to be displayed on one screen can be calculated as follows. Because the result is 24 (pixels)/72=0.333, the rate of pixels to be displayed on one screen becomes about 33.3%. In other words, in the first embodiment, an increase of pixels to be displayed on one screen from the number of pixels in the conventional example is calculated as follows. The result becomes about 44.4(%)/about 33.3(%)=about 133.3. The increase thus becomes about 33.3% (the rate of pixels displayed on one screen).

<Second Embodiment>

Hereunder, the second embodiment of the present invention will be described with reference to FIGS. 4 through 6. In this embodiment, the plasma display panel of the present invention applies to a PDP.

FIG. 4 shows a vertical front view of a PDP screen in the second embodiment of the present invention. On this PDP screen are disposed N (natural number) plasma cells in the horizontal direction, which is the longitudinal direction of the screen. In the vertical direction are disposed plasma cells divided in units of M cells. In other words, this PDP screen consists of N (rows)=M (columns) plasma cells; single color (B) plasma cells are arranged consecutively on every other line in the row direction and a line consisting of G color plasma cells and R color plasma cells that are arranged alternately in the column direction is disposed between lines consisting of those B color plasma cells respectively. In this second embodiment, a line consisting of cells arranged in a repetitive pattern of G, B, R, B, . . . and a line consisting of cells arranged in a repetitive pattern of R, B, G, B, . . . are alternated.

This second embodiment uses an interlace displaying method that repeats the first field and the second field alternately.

Figure 5:
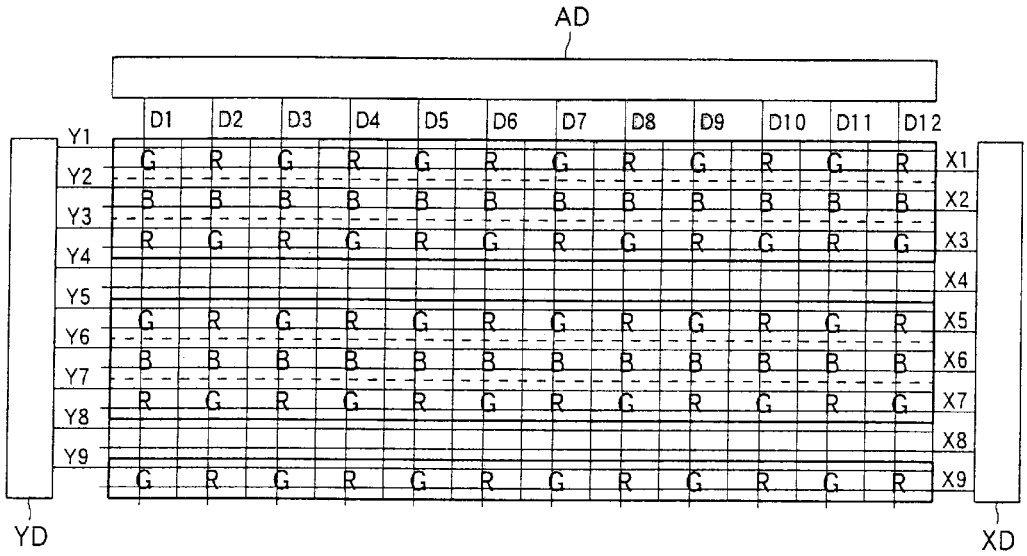
FIG. 5 is a first field in an interlace display with the cell arrangement in the second embodiment of the present invention.
Figure 6:
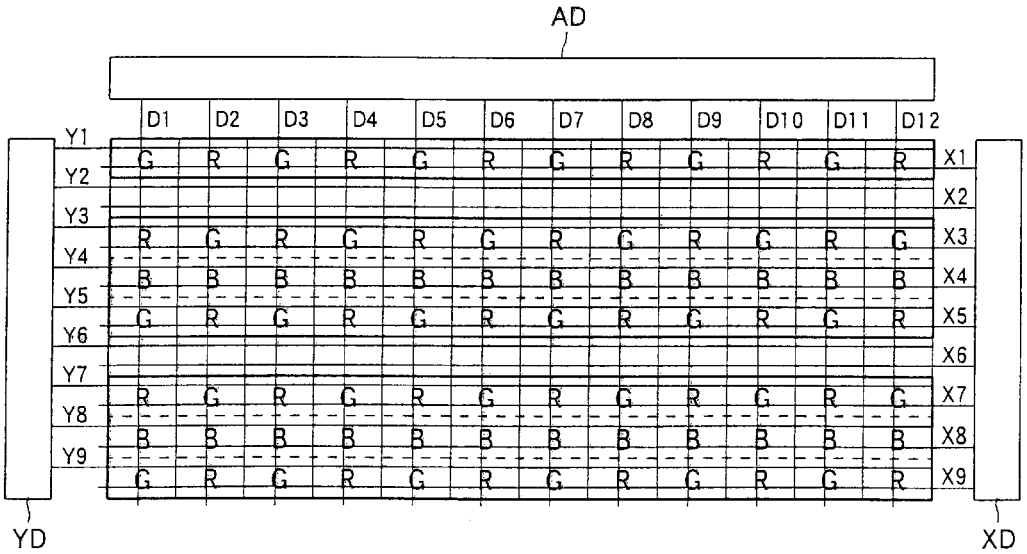
FIG. 6 is a first field in an interlace display with the cell arrangement in the second embodiment of the present invention.

FIG. 5 shows a display of the first field and FIG. 6 shows a display of the second field.

In the first field, scanning is done line by line sequentially, beginning at a B cell line, its adjacent line consisting of cells arranged in a repetitive pattern of G, R, G, R, . . . , then a line consisting of cells arranged in a repetitive pattern of R, G, R, G, . . . in colors.

Concretely, the scanning is done line by line sequentially, beginning at the first line L1 (consisting of cells arranged in a repetitive pattern of G, R, G, R, . . . ) on which the row electrode pair X1, Y1 is disposed, then the second line L2 (B cell line) on which the row electrode pair X2, Y2 is provided, the third line L3 (consisting of cells arranged in a repetitive pattern of R, G, R, G, . . . ) on which the row electrode pair X3, Y3 is provided, the fifth line L5 (consisting of cells arranged in a repetitive pattern of G, R, G, R, . . . ) on which the row electrode pair X5, Y5 is provided, the sixth line L6 (B cell line) on which the row electrode pair X6, Y6 is provided, the seventh line L7 (consisting of cells arranged in a repetitive pattern of R, G, R, G, . . . ) on which the row electrode pair X7, Y7 is provided, the ninth line L9 (consisting of cells arranged in a repetitive pattern of G, R, G, R . . . ) on which the row electrode pair X9, Y9 is provided, . . .

In the second field, scanning is done line by line sequentially, beginning at a B cell line, then an adjacent line consisting of cells arranged in a repetitive pattern of R, G, R, G, . . . , and another adjacent line consisting of cells arranged in a repetitive pattern of G, R, G, R, . . . in the second line group.

Concretely, the scanning is done line by line, beginning at the first line L1 (consisting of cells arranged in a repetitive pattern of G, R, G, R, . . . ) on which the row electrode pair X1, Y1 is disposed, then the third line L3 (consisting of cells arranged in a repetitive pattern of R, G, R, G . . . ) on which the row electrode pair X3, Y3 is provided, the fourth line L4 (B cell line) on which the row electrode pair X4, Y4 is provided, the fifth line L5 (consisting of cells arranged in a repetitive pattern of G, R, G, R, . . . ) on which the row electrode pair X5, Y5 is provided, the seventh line L7 (consisting of cells arranged in a repetitive pattern of R, G, R, G, . . . ) on which the row electrode pair X7, Y7 is provided, the eighths line L8 (B cell line) on which the row electrode pair X8, Y8 is provided, the ninth line L9 (consisting of cells arranged in a repetitive pattern of G, R, G, R . . . ) on which the row electrode pair X9, Y9 is provided, . . .

As described above, the first and second embodiments use an interlace scanning and driving method that scans and drives the number of B plasma display cells in the column direction, which is double the number of R plasma display cells and the number of G plasma display cells respectively.

Furthermore, in the first embodiment, the vertical resolution for G/R cells is a half of that for B cells. In the second embodiment, however, the luminance center of G/R cells comes to an intermediate line (B cell line) practically, since G and R cells are arranged alternately in the line (row) direction. This is why the vertical resolution for R/G cells can be improved.

<Third Embodiment>

FIG. 7 shows the third embodiment of the present invention, which is a variation of the first embodiment. Concretely, positions of color-arranged plasma display cells in the first embodiment are changed and the number of G plasma display cells in the column direction is set as double the number of B plasma display cells and the number of R plasma display cells. In this third embodiment, color arrangement in the column direction is done in a repetitive pattern of R, G, B, G, . . . The driving method that includes scanning of lines in the row direction is the same as that of the first embodiment.

<Fourth Embodiment>

FIG. 8 shows the fourth embodiment of the present invention, which is a variation of the first embodiment. Concretely, positions of color-arranged plasma display cells in the first embodiment are changed and the number of R plasma display cells in the column direction is set as double the number of B plasma display cells and the number of G plasma display cells respectively. The colors of the plasma display cells in the column direction are arranged in a repetitive pattern of G, R, B, R, . . . in this fourth embodiment.

The driving method that includes the scanning of lines in the row direction is the same as that of the first embodiment.

<Fifth Embodiment>

FIG. 9 shows the fifth embodiment of the present invention.

FIG. 9 shows a vertical front view of a PDP screen in this fifth embodiment. On this PDP screen are disposed N (natural number) plasma cells in parallel in the horizontal direction, which is the longitudinal direction of the screen. In the vertical direction, plasma display cells are divided in units of M cells. In other words, the PDP screen consists of N (rows)×M (columns) of plasma cells. Single color (R) cells are disposed on every other line in the row direction. Between such R cell lines is disposed a line consisting of G and B plasma display cells that are arranged alternately. In this embodiment, a line consisting of cells arranged in a repetitive pattern of G, R, B, R, . . . and a line consisting of cells arranged in a repetitive pattern of B, R, G, R, . . . are alternated.

The driving method that includes the scanning of lines in the row direction is the same as that of the first embodiment.

<Sixth Embodiment>

FIG. 10 shows the sixth embodiment of the present invention.

FIG. 10 shows a vertical front view of a PDP screen in this sixth embodiment. On this PDP screen are disposed N (natural number) plasma cells in parallel in the horizontal direction, which is the longitudinal direction of the screen. In the vertical direction, plasma cells are divided in units of M cells. In other words, the PDP screen consists of N (rows)×M (columns) of plasma cells. In the row direction, single color (G) plasma cells are arranged consecutively on every other line. And, between such lines consisting of G cells respectively is disposed a line consisting of G and R plasma cells that are alternated in the column direction. In this sixth embodiment, a line consisting of cells arranged in a repetitive pattern of R, G, B, G, . . . and a line consisting of cells arranged in a repetitive pattern of B, G, R, G, . . . are alternated.

The driving method that includes the scanning of lines in the row direction is the same as that of the first embodiment.

In the second to sixth embodiments, the rate of pixels displayed on one screen to all the pixels is the same as that of the first embodiment, so that the number of pixels displayed on one screen increases by about 33.3% from the conventional one.

As described above, in this sixth embodiment, it is possible to provide a higher definition plasma display than any conventional one without changing the sizes of the plasma display cells in both length and width. In addition to such the plasma display, it is also possible to apply the present invention as a display apparatus to such matrix displays as organic EL displays, FEDs, liquid crystal displays, etc.

According to the present invention, therefore, it is possible to realize high definition pixels for a plasma display in which three cells, each having a luminescent color and a reflected light different from others are arranged in a matrix (PDP, organic EL display, FED, liquid crystal display, etc.) without reducing the sizes of those cells in both length and width. In addition, the display requires no modification of circuits; it is just required to use the interlace scanning method that changes the order to scan the cells arranged in a matrix and change the disposition of the matrix display. As a result, the above described high definition pixels can be achieved at a low cost.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 2001-219112 filed on Jul. 19, 2001 including the specification, claims, drawings and summary is incorporated herein by reference in its entirety.

What is claimed is:

1. A display panel comprising a plurality of cells that are arranged in a matrix, each of the plurality of cells emitting a different unique luminescent color;

wherein a plurality of cells each bearing first luminescent color are disposed on every other line in a vertical direction, and a line of cells each having second luminescent color and a line of cells each having third luminescent color are alternated with a line of said plurality of cells having first luminescent color respectively therebetween.

2. A display panel comprising a plurality of cells that are arranged in a matrix, each of the plurality of cells emitting a different unique luminescent color;

wherein said plurality of cells having first luminescent color respectively are disposed on every other line in a vertical direction and a line on which cells having said second luminescent color and cells having said third luminescent color are disposed alternately between lines consisting of cells having said first luminescent color respectively.

3. The display panel according to claim 1;

wherein said display panel is a plasma display panel.

4. A scanning method used in a display panel comprising a plurality of cells that are arranged in a matrix, each of the plurality of cells emitting a different unique luminescent color;

wherein said scanning method uses an interlacing method to drive said display panel in which a plurality of cells each bearing first luminescent color are disposed on every other line in a vertical direction and a line of cells having second luminescent color and a line of cells having third luminescent color are disposed alternately with a line of cells having said first luminescent color therebetween;

wherein a plurality of lines, each consisting of cells having said first luminescent color, are divided into a first line group and a second line group so that lines of said first and second groups are alternated;

wherein scanning in a first field is done sequentially for a line consisting of cells having said first luminescent color, then its adjacent line consisting of cells having said second or third luminescent color in said first line group; and wherein scanning in a second field is done sequentially for a line consisting of cells having said first luminescent color, then its adjacent line consisting of cells having said second or third luminescent color in said second line group.

5. A scanning method used in a display panel comprising a plurality of cells that are arranged in a matrix, each of the plurality of cells emitting a different unique luminescent color;

wherein said scanning method uses an interlacing method to drive said display panel in which a plurality of cells each bearing first luminescent color are disposed on every other line in a vertical direction and a plurality of cells having second luminescent color and a plurality of cells having third luminescent color are disposed alternately in a line between lines, each consisting of cells having said first luminescent color;

wherein a plurality of lines, each consisting of cells having said first luminescent color, are divided into a first line group and a second line group so that a line in said first line group and a line in said second line group are alternated;

wherein scanning in a first field is done sequentially for a line of cells having said first luminescent color, then its adjacent line on which cells having said second luminescent color and cells having said third luminescent color are disposed alternately in said first line group; and wherein scanning in a second field is done sequentially for a line consisting of cells having said first luminescent color, then its adjacent line on which cells having said second luminescent color and cells having said third luminescent color are disposed alternately in said second line group.

6. The scanning method according to claim 4;

wherein said display panel is a plasma display panel.

* * * * *

UNITED STATES PATENT AND TRADEMARK OFFICE

CERTIFICATE OF CORRECTION

PATENT NO. : 6,888,516 B2
DATED : May 3, 2005
INVENTOR(S) : Mario Amatsuchi et al.

It is certified that error appears in the above-identified patent and that said Letters Patent is hereby corrected as shown below:

Title page,
Item [73], Assignees, delete "Pioneer Display Corporation" and insert
-- Pioneer Display Products Corporation --.

Signed and Sealed this

Third Day of January, 2006

JON W. DUDAS
*Director of the United States Patent and Trademark Office*